United States Patent [19]

Sachtler et al.

[11] Patent Number: 4,795,550

[45] Date of Patent: Jan. 3, 1989

[54] REMOVAL OF TRACE OLEFINS FROM AROMATIC HYDROCARBONS

[75] Inventors: J. W. Adriaan Sachtler, Des Plaines; Paul T. Barger, Arlington Heights, both of Ill.

[73] Assignee: UOP Inc., Des Plaines, Ill.

[21] Appl. No.: 34,811

[22] Filed: Apr. 3, 1987

[51] Int. Cl.[4] ..... C10G 25/03

[52] U.S. Cl. ..... 208/307; 208/177; 208/299; 585/467; 585/468

[58] Field of Search ..... 208/310 Z, 177, 299, 208/307; 585/804, 809, 829, 467, 468

[56] References Cited

U.S. PATENT DOCUMENTS

| | | | |
|---|---|---|---|
| 2,778,863 | 1/1957 | Maisel et al. | 260/674 |
| 3,400,169 | 9/1968 | Eng et al. | 260/674 |
| 3,835,037 | 9/1974 | Fairweather et al. | 208/260 |
| 3,888,939 | 6/1975 | Rosback | 208/310 Z |
| 4,309,281 | 1/1982 | Dessau | 208/310 Z |
| 4,395,372 | 7/1983 | Kluttz et al. | 260/465 R |
| 4,421,941 | 12/1983 | Olson et al. | 585/467 |

*Primary Examiner*—Patrick P. Garvin
*Assistant Examiner*—George R. Fourson
*Attorney, Agent, or Firm*—Thomas K. McBride; John F. Spears, Jr.; David M. Frischkorn

[57] ABSTRACT

This invention presents a novel treating process for the removal of trace quantities of olefinic impurities from a hydrocarbon process stream. Specifically, this process operates at liquid phase conditions treating hydrocarbon streams comprising substantially aromatics and naphthenes having Bromine Index values of about 50 to 2,000. A solid medium comprising a crystalline aluminosilicate zeolite and a refractory oxide is used to reduce the level of olefin impurities to Bromine Index values of 0.1 to 50.

7 Claims, No Drawings

REMOVAL OF TRACE OLEFINS FROM AROMATIC HYDROCARBONS

BACKGROUND AND PRIOR ART

This invention presents a novel treating process for the removal of trace quantities of olefinic impurities from hydrocarbon process streams containing predominantly cyclic compounds, specifically aromatic and naphthenic hydrocarbons. More particularly, this treating process uses a solid medium comprising crystalline aluminosilicate zeolite and refractory inorganic oxide to reduce the olefin level of hydrocarbon process streams to less than 50 Bromine Index. A more efficient olefin removal process with minimal deleterious transalkylation reactions is achieved with the present invention compared to processes of the prior art.

Olefinic hydrocarbon impurities are commonly found in aromatic hydrocarbon process streams originating from naphtha fractions of petroleum and from reforming or steam cracking of naphthas. Alternatively, olefins can also be formed as by-products in a number of petrochemical processes, for example, in isomerization and transalkylation processes. Removal of these olefins is important for several reasons. One is to meet product specification or purity standards required by aromatic producers. If the olefins are not removed, there is a high probability that they will undergo reaction with other compounds to produce undesirable coproducts, such as, colored materials in benzene sulfonates. Olefin removal is also important in order to protect certain petrochemical processes which are particularly sensitive to olefins even in concentrations as low as a few parts per million. For example, in a separation process that uses molecular sieves, olefins will occupy sieve capacity and thereby adversely affect separation performance. Another reason for removal is because olefins can cause fouling in high temperature equipment, such as, in a xylene column reboiler. The current practice for removing olefin contaminants involves the use of the clay treating process. Here a hydrocarbon stream is contacted with a clay, such as, activated bentonite, Attapulgus clay, fuller's earth, Superfiltrol, Floridin, and the like. These clays are composed primarily of amorphous and crystalline mixtures of silica and alumina. However, although some types of clays exhibit a minor degree of crystallinity, they are readily distinguishable from the structure and crystallinity of crystalline aluminosilicate zeolites. The acidic nature of the clays cause the olefins to react with the aromatics present via an alkylation reaction whereby heavy hydrocarbons are produced which are subsequently removed by fractional distillation.

An example of such a clay treating process is taught in U.S. Pat. No. 2,778,863 (Maisel et al). This reference teaches a process to remove olefins from $C_6$ and $C_7$ aromatic hydrocarbon concentrates by successive contacting with clay followed by intermediate fractional distillation. The clays of the U.S. Pat. No. 2,778,863 reference are of the naturally occurring type. Similarly, U.S. Pat. No. 3,835,037 (Fairweather et al) teaches the removal of color-generating olefinic impurities from aromatic hydrocarbons via oligomerization/polymerization at low temperature using either a natural occurring clay material or a sythetic alumina and/or silica-containing material, e.g., silica-magnesia, silica-zirconia, etc.

Another approach to the problem of removing impurities from aromatic containing hydrocarbon streams is described in U.S. Pat. No. 3,400,169 (Eng et al). Here, a slurry of silica alumina catalytic cracking catalyst and steam cracked naphtha is contacted with a second stream of steam cracked naphtha in a tower zone to polymerize olefins and convert thiophenes to paraffins and $H_2S$. The catalyst of this process may contain 13–30% of alumina and 70–87% silica.

We have now found a treating process for removing olefinic impurities from process streams containing substantially aromatic hydrocarbons which does not use the traditional amorphous clay material, but instead employs a crystalline aluminosilicate zeolite and a refractory inorganic oxide. Treating of such process streams also does not significantly change the quantity or distribution of the aromatic hydrocarbons treated.

OBJECTS AND EMBODIMENTS

The principal object of the instant invention is to provide a treating process for removing olefinic hydrocarbon impurities from hydrocarbon process streams containing substantially aromatic and naphthenic hydrocarbons. Further, when compared to processes of the prior art, the instant treating process reduces the olefin content more efficiently and to a greater degree without the high levels of deleterious transalkylation reaction by-products commonly attributable to the clay treating processes of the prior art.

Accordingly, a broad embodiment of the instant invention is to provide a process for treating a hydrocarbon process stream to remove trace quantities of olefinic impurities comprising contacting the process stream comprising substantially aromatic and naphthenic hydrocarbons having a Bromine Index of from about 50 to about 2000 at olefin removal conditions which ensure liquid phase operation with a solid medium comprising a crystalline aluminosilicate zeolite and a refractory inorganic oxide to produce an essentially olefin-free product stream with approximately the same quantity and distribution of aromatic and naphthenic hydrocarbons as contained in the process stream.

The preferred crystalline aluminosilicate zeolite is faujasite and is present in an amount from about 10 to 90 percent by weight of the catalyst. The refractory inorganic oxide can be alumina, silica-alumina, or a mixture of both. The alumina is selected from the group consisting of gamma-alumina, eta-alumina, and mixtures thereof.

The olefin removal conditions comprise a temperature of from about 37°–260° C., an aromatics liquid hourly space velocity of from about 0.5 to about 10 $hr^{-1}$, and a pressure sufficient to maintain the process stream liquid phase.

These, as well as other embodiments of the present invention, will become evident from the following, more detailed description.

DETAILED DESCRIPTION

This invention presents a novel treating process for the removal of trace quantities of olefinic impurities from a hydrocarbon process stream. Prior to the instant invention, only two practical methods have been discovered for removing trace olefins; one involves hydrotreating and the other involves clay treating. Hydrotreating, which saturates the olefins to the paraffinic equivalent, has been found to be prohibitively expensive in many applications where it is essential to remove olefin impurities. Hydrotreating requires a sophisticated catalyst system, a high pressure vessel and other associated equipment and in addition a source of make-up hydrogen. Clay treating on the other hand is a relatively simple process, however, deleterious side-reactions such as, cracking, isomerization and transalkylation, consume valuable products and produce undesirable by-products. In order to preserve product quality or protect downstream processes, these undesirable by-products must be removed eventually from the final product.

The instant invention provides a third method for removing trace quantities of olefins from process streams without the drawbacks associated with hydrotreating and clay treating. Although the instant invention does involve a minor amount of catalytic reaction with respect to the removal of the olefinic impurities, it is important to note that the instant treating process does not involve a conventional conversion process as is defined by the common usage of the term "conversion". The process of the instant invention does not involve the purposeful combining of two or more compounds with the aim being to produce a useful product. In other words, the treating process of the instant invention does not create to any appreciable extent new compounds or for that matter decrease to any significant degree the quantity of the non-olefinic hydrocarbon compounds fed to the treating process. In a preferred mode of operating the treating process, less than 1 wt. % of the non-olefinic hydrocarbons contained in the feed stream are converted to different hydrocarbon compounds. Weight percent conversion is defined as the weight of a particular hydrocarbon compound in the feed minus the weight of the same compound in the product divided by the weight in the feed, and the quotient multiplied by 100. For example, if the feed contained 95 wt. % $C_8$ aromatics, then the product exiting the treating process will contain no less than 94 wt. % $C_8$ aromatics. In summary then, it is a requirement of the invention that there be no measurable increase or decrease of aromatic and naphthenic hydrocarbons as a result of contacting the process stream with the solid medium at the treating conditions specified.

Suitable process streams for treating with the process of the instant invention include any hydrocarbon stream comprised substantially of aromatic and naphthenic hydrocarbons. What is meant by the term "substantially" is that the aromatic and naphthenic hydrocarbons are the only dominant hydrocarbon species and thus all other hydrocarbons that are present are as reaction by-products from other hydrocarbon processes and not intentionally included with the aromatics and naphthenes. It is preferred that the process stream contain at least 80 wt. % aromatics having between 6 and 20 carbon atoms per molecule. Representative of process streams suitable for treating by the instant invention include steam cracked and catalytically reformed naphthas (80–90 wt. % aromatics and naphthenes), aromatic isomerization feeds and products (ethylbenzene, xylenes, diethylbenzenes, methyl-, ethyl-, and dimethylnaphthalenes), transalkylation feeds and products (toluene, benzene, xylenes, trimethylbenzenes, cumene, diisopropylbenzenes), products from an alkylation process (ethylbenzene, diethylbenzene, cumene, diisopropylbenzene, $C_{16}$–$C_{20}$ linear alkylbenzenes), extract product from an aromatics extraction process ($C_6$–$C_9$ aromatics), pure component product streams containing, for example, toluene, benzene or xylenes and thermal dealkylation feed and product streams (toluene, $C_9$+aromatics).

The suitable process streams just mentioned necessarily contain an unacceptable quantity of trace olefinic hydrocarbon impurities. What is meant by "trace quantities" is that the process stream contains less than 5 wt. % of olefinic compounds. These trace olefins take the form of mono- and di-unsaturated aliphatic hydrocarbons of varying carbon number. Because of the relatively low quantity found in such streams, it is customary in the industry to measure trace olefins using the analytical method known as the Bromine Index (ASTM D 1491). The Bromine Index indirectly measures the olefin content of aromatic containing hydrocarbon samples using potentiometric titration. Specifically, the Bromine Index is defined as the number of milligrams of bromine consumed by 100 grams of hydrocarbon sample. To illustrate more clearly how small the quantity of olefins is in the process streams of the instant invention, it is instructional to present the following example. Assume that a process stream containing substantially xylenes is measured to have a Bromine Index of 100. This means that 100 mg of bromine has reacted with the olefinic hydrocarbons present in a 100 gram sample of the xylene process stream. If it is assumed that the olefins are monoolefins and have 8 carbon atoms per molecule, then the quantity of olefins in the process stream is equal to about 0.14 wt. %. This example clearly demonstrates the low level of olefinic hydrocarbons present in the process streams of the instant invention.

Represent trace olefin quantities for various suitable process streams are presented in the Table below.

| Process Stream | Bromine Index |
|---|---|
| Hydrogenated Steam Cracked Naphthas | 100–200 |
| Catalytic Reformed Naphthas | 1,000–2,000 |
| Extracted Aromatics | 50–100 |
| Heavy Aromatic Streams ($C_9$+) | 145–350 |
| Benzene Product Streams | 50–150 |
| Toluene Product Streams | 50–150 |
| Xylene Product Streams | 50–300 |

The instant treating process is capable of reducing the amount of trace olefins of process streams having Bromine Index of about 50 to about 2,000 to levels of 0.1 to 50 Bromine Index.

In contrast to the catalysts employed by prior art olefin removal processes, the process of the present invention utilizes a solid medium comprising a crystalline aluminosilicate zeolite and refractory inorganic oxide. The term "crystalline aluminosilicate zeolite" is used in the present invention to mean non-clay containing compositions. Zeolites include both naturally occurring and synthetic varieties and may be represented by the empirical formula:

$$M_{2/n}\cdot Al_2O_3\cdot xSiO_2\cdot yH_2O$$

in which n is the valence of M which is generally an element of Group I or II, in particular, sodium, potassium, magnesium, calcium, strontium, or barium, and x is generally equal to or greater than 2. Zeolites have skeletal structures which are made up of three dimensional networks of $SiO_4$ and $AlO_4$ tetrahedra, corner linked to each other by shared oxygen atoms. Known zeolites include the natural zeolites faujasite, mordenite, erionite, and chabazite, and synthetic zeolites A, L, S, T, X and Y. A relatively new class of zeolites known as pentasils include the ZSM variety and are characterized by high silica to alumina ratios, typically from 12 to 30 or more. It is within the scope of the present invention that the crystalline aluminosilicate component may contain catalytically effective amounts of metal promoters, such as Group VIII metals, Group III metals, or rare earth metals of the Periodic Table.

The preferred class of zeolite of the instant invention is faujasite, including both synthetic X and Y types. Most preferred is the Y type as disclosed generally in U.S. Pat. No. 3,130,007, incorporated herein by reference. The crystals of zeolite Y are basically threedimensional frameworks of $SiO_4$ and $AlO_4$ tetrahedra crosslinked by sharing of oxygen atoms. The electrovalence of each tetrahedron containing aluminum is balanced by the presence in the aluminosilicate framework of a cation such as an alkali metal ion. The void spaces in the framework are occupied by water molecules.

The zeolite component utilized in the present invention may be modified by any known technique. Modification of the zeolite component, for example, by increasing the $SiO_2$ to $Al_2O_3$ ratio or by incorporating metal cations in the zeolite, can dramatically alter the ultimate performance of the final catalytic composite. Modifications that lead to higher activities and selectivities are desired. Included among the modification techniques are ion exchange, hydrothermal treatment, dealumination processes, calcination, and/or combinations thereof.

The crystalline aluminosilicate zeolite component is incorporated with a refractory inorganic oxide and formed into a solid medium composite. The formed catalyst composite may be prepared by any known method in the art including either the well-known oil drop or extrusion methods. The catalytic composite may be shaped into any useful form, such as spheres, pills, cakes, extrudates, powders, granules, tablets, etc., and utilized in any desired size. The crystalline aluminosilicate zeolite may be present in an amount within the range of 10 to about 99.5 wt. %, preferably within the range of 10 to about 90 wt. %, and the refractory inorganic oxide may be present in an amount within the range of from 0.5 to about 90 wt. %.

The preferred inorganic oxides for use in the present invention are alumina, silica-alumina, or a mixture of both. The alumina is preferably selected from the group consisting of gamma-alumina, etaalumina and mixtures thereof. Ratios of silica to alumina may range from about 20:80 to about 80:20 by weight. Other refractory inorganic oxides which are contemplated include, for example, silica gel, magnesia-alumina, zirconia-alumina, phosphorus-alumina and the like.

Regardless of the particular process stream chosen to remove trace olefins, it is necessary that the stream be contacted with the solid medium composite in a reaction zone at olefin removal conditions. This contacting may be accomplished in a fixed bed, a moving bed system, a fluidized bed system, a batch type operation, or any other mode known in the art. The olefin removal conditions will, of course, vary depending on such factors as feedstock composition, level of olefinic hydrocarbons, and desired degree of removal. Generally, it is preferred that the olefin removal conditions be chosen such that the process stream remains liquid phase during the removal process. A range of olefin removal conditions include a temperature of from about 5° to about 270° C., a liquid hourly space velocity from about 0.5 to 50 $hr^{-1}$, and a pressure of from about atmospheric to 6895 kPa (ga). The preferred olefin removal conditions for the instant invention are a temperature from about 37° to about 260° C., a liquid hourly space velocity from 1.0 to 10 $hr^{-1}$, and a pressure from about 101 to about 4137 kPa (ga).

It is within the scope of this invention that upon conclusion of the useful life of the solid medium composite, usually determined by loss in the ability to remove the olefins to the desired level, the composite may be subjected to a regeneration procedure. Any regeneration procedure known in the art may be employed, such as single or multiple exposure of the composite to oxidation and/or $H_2$ reduction procedures.

Although not wanting to be bound by a particular theory, it is believed that the trace quantities of olefinic impurities undergo reactions including alkylation with either aromatics or naphthenic hydrocarbons and hydrogeneration to the corresponding paraffin. The quantities of compounds formed by these reactions are so minute that actual measurement by analytical methods is not practical. It is sufficient that no observable change in either quantity or distribution of the aromatics and naphthenes of the process stream is evident in the olefin-free product stream leaving the treating process.

The following examples will serve to illustrate certain specific embodiments of the herein disclosed invention. These examples should not, however, be construed as limiting the scope of the invention as set forth in the claims as there are many variations which may be made thereon without departing from the spirit of the invention, as those of skill in the art will recognize.

EXAMPLE I

Removal of olefinic hydrocarbons from an aromatic containing process stream utilizing the process of the instant invention was demonstrated by pilot plant testing. A sample of a commercial process stream representing the product from an isomerization process was contacted with a solid medium at a pressure of 979 kPa (ga), a liquid hourly space velocity of 4.0 $hr^{-1}$, and at temperatures of 175°-200° C. (16 hours at each temperature). The sample contained about 87 wt. % $C_8$ aromatics as an equilibrium mixture of ethylbenzene and xylenes and had a Bromine Index of approximately 280. This sample also contained 5 wt. % of $C_8$ naphthenes. The solid medium used in the demonstration comprised a mixture of approximately 13 wt. % Y-type crystalline aluminosilicate zeolite, 20 wt. % gamma-alumina, 0.54 wt. % neodymium, 0.17 wt. % praseodymium, 0.75 wt. % cerium, 0.76 wt. % lanthanum, and the balance refractory silica-alumina. Because the Bromine Index is a direct indication of the olefin content of the feed, a measure of the reduction in Bromine Index of the product from the process represents the degree of olefin removal. The transalkylation activity of the solid medium of this example was determined by contacting a process stream, representing the feed to the same isomerization process described above at the same conditions as used for the reduction of the Bromine Index. This process stream contained a non-equilibrium mixture of about 92 wt. % $C_8$ aromatics and ethylbenzene and 7 wt. % $C_8$ naphthenes. The transalkylation activity, measured by the formation of benzene and $C_9+C_{10}$ aromatics, is a relative indication of the loss of desired $C_8$ aromatics, i.e., the higher the benzene and $C_9+C_{10}$ aromatics level in the product, the greater the $C_8$ aromatics loss. The degree of olefin removal and the transalkylation activity are shown in the table below, designated as Test I. Also included in the table, designated as Test II, are the results of a conventional commercial process employing a catalyst composed primarily of activated clay. The olefin removal conditions were identical to those employed during Test I.

| | Test I | | Test II | |
|---|---|---|---|---|
| Reaction Temperature, °C. | 175 | 200 | 175 | 200 |
| Product Bromine Index, mg Br/100 g | 1.1 | 2.3 | 0.4 | 0.3 |
| % Olefin Removal | 99.6 | 99.2 | 99.9 | 99.9 |
| Transalkylation Activity, wt. ppm | | | | |
| Benzene | 30 | 60 | 810 | 2500 |
| $C_9 + C_{10}$ Aromatics | 50 | 110 | 1010 | 3590 |

It is readily observed that both processes achieve comparably high olefin removal efficiencies, but the process of the instant invention does so without appreciable levels of transalkylation activity. The prior art process of Test II has a yield of deleterious transalkylation by-products over 15 times that of the instant process of Test I. Thus, the prior art process must sacrifice desired $C_8$ aromatic products to achieve a high level of olefin removal.

Clearly, these results show that the process disclosed herein achieves almost complete removal of olefins while minimizing the disadvantageous transalkylation side reactions.

EXAMPLE II

This treating process of the instant invention was used to remove trace olefins from a sample of commercial feedstock containing approximately 94.5 wt. % cumene. The Bromine Index of this feedstock was 85. Three different solid mediums were evaluated in a pilot plant and compared to the results obtained using a prior art clay-containing composite. The olefin removal conditions included a temperature of 100° C., a cumene liquid hourly space velocity of 2 $hr^{-1}$, and a pressure of 68.9 kPa (ga). These conditions were sufficient to maintain the cumene liquid phase. Again, a reduction in the Bromine Index is a measure of the effectiveness of olefin removal. The Table below presents the results. Test III utilized a solid medium comprising 50 wt. % hydrogen-form Y-zeolite having a framework silicon to aluminum mole ratio of 3.9 and 50 wt. % $SiO_2$, Test IV utilized a composite of 50 wt. % of a fully rare earth exchanged Y-zeolite containing neodymium, praseodymium, cerium and lanthanum cations and 50 wt. % $SiO_2$ and Test V utilized a composite of 50 wt. % hydrogen-form Y-zeolite having a framework silicon to aluminum mole ratio of 2.7 and 50 wt. % $SiO_2$. The prior art clay composite was evaluated in Test VI.

| Test No. | III | IV | V | V1 |
|---|---|---|---|---|
| Product Bromine Index, mg Br/100 g | <1 | 14 | 8 | 57 |
| % Olefin Removal | 99 | 84 | 91 | 32 |

These results show the process of the instant invention provides an effective method to reduce olefinic hydrocarbon impurities from a process stream containing substantially cumene.

We claim:

1. A process for treating a hydrocarbon process stream by converting trace quantities of olefinic impurities to nonolefinic hydrocarbons, which process comprises contacting the process stream, which contains trace olefins in an amount of from about 50 to about 2000 as measured by Bromine Index and at least 80% by weight of aromatic and naphthenic hydrocarbons having from 6 to 20 carbon atoms per molecule, at reaction conditions which ensure liquid phase operation with a solid catalyst composite comprising a crystalline aluminosilicate zeolite and a refractory inorganic oxide to produce by a catalytic olefin-consuming alkylation reaction an essentially olefin-free product stream with approximately the same quantity and distribution of aromatic and naphthenic hydrocarbons as contained in the process stream.

2. The process of claim 1 further characterized in that the treating conditions include a temperature of from about 37° to about 260° C., a pressure sufficient to maintain the process stream liquid phase, and a liquid hourly space velocity of from about 1 to about 10 $hr^{-1}$.

3. The process of claim 1 further characterized in that the crystalline aluminosilicate zeolite is faujasite.

4. The process of claim 3 further characterized in that the faujasite is zeolite-Y.

5. The process of claim 3 further characterized in that the solid medium contains from about 10 to about 90% crystalline aluminosilicate zeolite.

6. The process of claim 1 further characterized in that the refractory inorganic oxide is selected from the group consisting of gamma-alumina, eta-alumina, silica-alumina, and mixtures thereof.

7. The process of claim 1 further characterized in that the olefin-free product stream will have a Bromine Index from 0.1 to 50.

* * * * *